US007347707B2

(12) United States Patent
Ho

(10) Patent No.: US 7,347,707 B2
(45) Date of Patent: Mar. 25, 2008

(54) ELECTRICAL CONNECTOR

(75) Inventor: Chien-Chih Ho, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/331,072

(22) Filed: Jan. 13, 2006

(65) Prior Publication Data

US 2007/0054532 A1 Mar. 8, 2007

(30) Foreign Application Priority Data

Sep. 8, 2005 (CN) ..... 2005 2 0064181 U

(51) Int. Cl.
*H01R 13/62* (2006.01)

(52) U.S. Cl. ..... 439/331; 439/73

(58) Field of Classification Search ..... 439/73, 439/330, 331, 910

See application file for complete search history.

(56) References Cited

U.S. PATENT DOCUMENTS 4,012,117 A * 3/1977 Lazzery ..... 349/60
6,561,825 B1 * 5/2003 McHugh et al. ..... 439/135
6,776,625 B2 * 8/2004 Ma ..... 439/73
6,780,024 B2 * 8/2004 Ma ..... 439/73
6,929,495 B2 * 8/2005 Ma ..... 439/331
6,939,140 B2 * 9/2005 Liao ..... 439/41
6,971,902 B2 * 12/2005 Taylor et al. ..... 439/342
7,014,477 B2 * 3/2006 Tsai ..... 439/71

* cited by examiner

*Primary Examiner*—Thanh-Tam Le
(74) *Attorney, Agent, or Firm*—Troxell Law Office, PLLC

(57) ABSTRACT

An electric connector used for connecting a chip module includes an insulating body, an electric conducting terminal, a latch base, and an attaching cover, and both sides of the attaching cover press on both sides of the latch base respectively. Both sides of the attaching cover of the electric connector of the invention press on both sides of the latch base respectively, such that both ends of the attaching cover can be fixed directly onto both ends of the latch base without being fixed onto the metal upper casing of the latch base, so as to avoid redesigning the attaching cover when there is a slight modification of the structure of the metal upper casing that the attaching cover cannot be installed onto the metal upper casing, and effectively lowering the design and development cost and enhancing the universal applicability of the attaching cover.

11 Claims, 9 Drawing Sheets

ELECTRICAL CONNECTOR

BACKGROUND OF THE INVENTION

1. Field of the Invention

The present invention relates to an electric connector, and more particularly to an electric connector having an attaching cover.

2. Description of the Related Art

At present, the electric connector used by manufacturers to connect a chip module with a circuit board generally comprises a metal base, a metal upper casing, a lever, and an insulating body containing a plurality of electric conducting terminals, and the metal base of such electric connector is a square frame structure for accommodating the insulating body therein, and the electric conducting terminals in the insulating body (or the solder ball under the electric conducting terminal) are soldered onto the circuit board. Since the soldering temperature is high, the electric connector cannot be gripped by hands directly. It is necessary to use a vacuum attaching device to suck and attach the electric connector onto the circuit board and align the terminals of the electric connector precisely to the soldering hole or conducting plate, and then solder the terminals with the circuit board. The electric connector does not come with a flat surface with a large area, and an attaching cover is usually installed on the electric connector to facilitate the sucking by the vacuum attaching device. The attaching cover installed on the metal upper casing has a flat surface to be sucked by the vacuum attaching device.

However, the attaching cover is installed on the metal upper casing, and thus the attaching cover cannot be installed on the metal upper casing anymore whenever there is a slight modification of the metal upper casing. It is necessary to redesign the attaching cover when the metal upper casing is modified, and thus incurring additional manufacturing costs. An improved electric connector is needed to overcome the foregoing shortcoming.

SUMMARY OF THE INVENTION

In view of the description above, the inventor of the present invention based on years of experience of the design and sales of computer connector products to conduct extensive experiments and tests in hope of overcoming the foregoing shortcomings of the prior art electric connector which is unfavorable for a dense module layout and produces a higher electric inductance with the adjacent electric conducting terminals, and finally invented an electric connector in accordance with the present invention.

An objective of the present invention is to provide an electric connector having an attaching cover.

Another objective of the present invention is to provide an electric connector with a lower cost.

To achieve the foregoing objectives, the electric connector of the invention provided for connecting a chip module comprises an insulating body, an electric conducting terminal, a latch base, and an attaching cover, and both sides of the attaching cover press onto both sides of the latch base.

Compared with the prior art, both sides of the attaching cover of the electric connector of the present invention press onto both sides of the latch base respectively, and both ends of the attaching cover can be fixed directly to both ends of the latch base without being fixed onto the metal upper casing of the latch base, and thus can avoid redesigning the attaching cover that cannot be installed onto the metal upper casing, whenever the metal upper casing is modified slightly, so as to effectively lower the design and development cost as well as enhancing the universal applicability of the attaching cover.

To make it easier for our examiner to understand the objective of the invention, its structure, innovative features, and performance, we use a preferred embodiment together with the attached drawings for the detailed description of the invention.

DETAILED DESCRIPTION OF THE PREFERRED EMBODIMENTS

Figure 1:
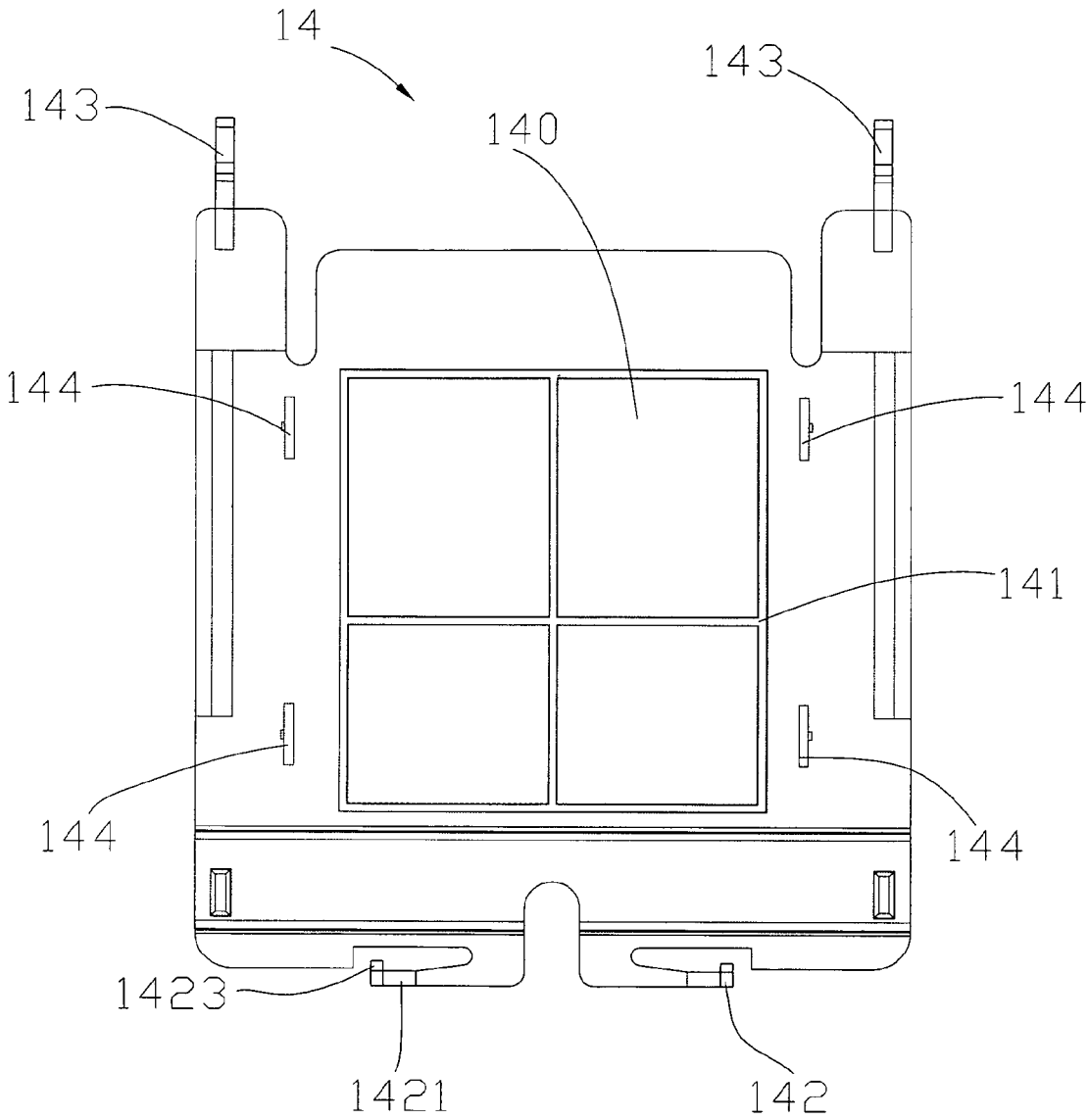
FIG. 1 is a top view of an attaching cover of an electric connector according to a preferred embodiment of the present invention.
Figure 2:
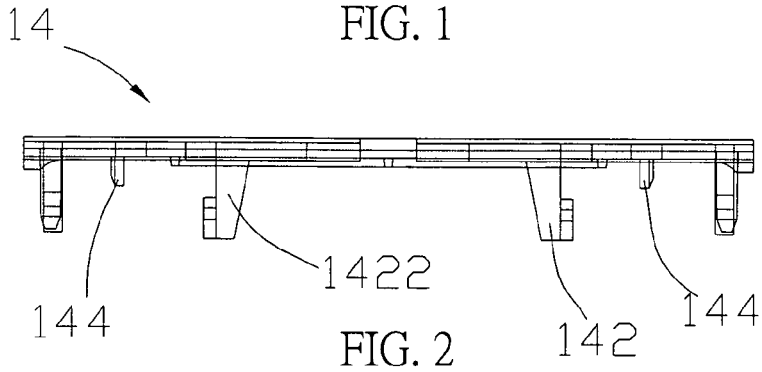
FIG. 2 is a main side view of attaching cover as depicted in FIG. 1.
Figure 3:
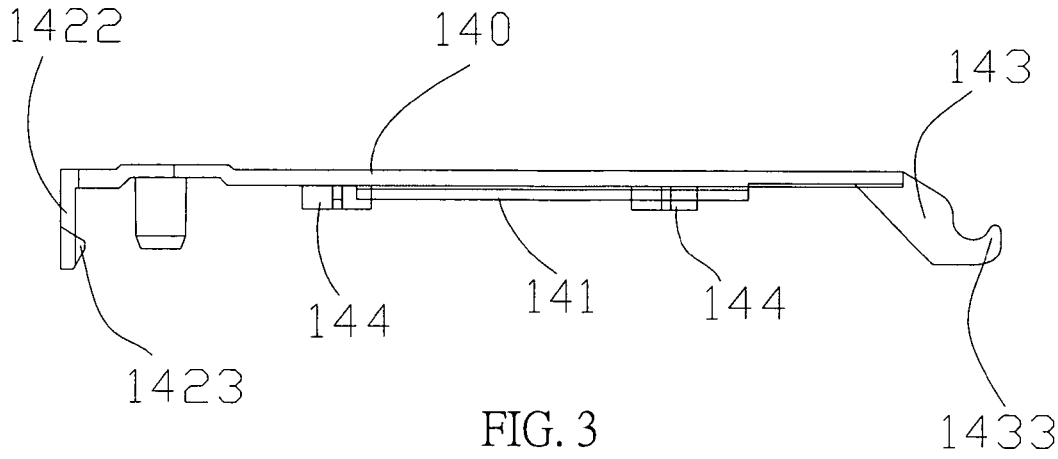
FIG. 3 is a right side view of attaching cover as depicted in FIG. 1.
Figure 4:
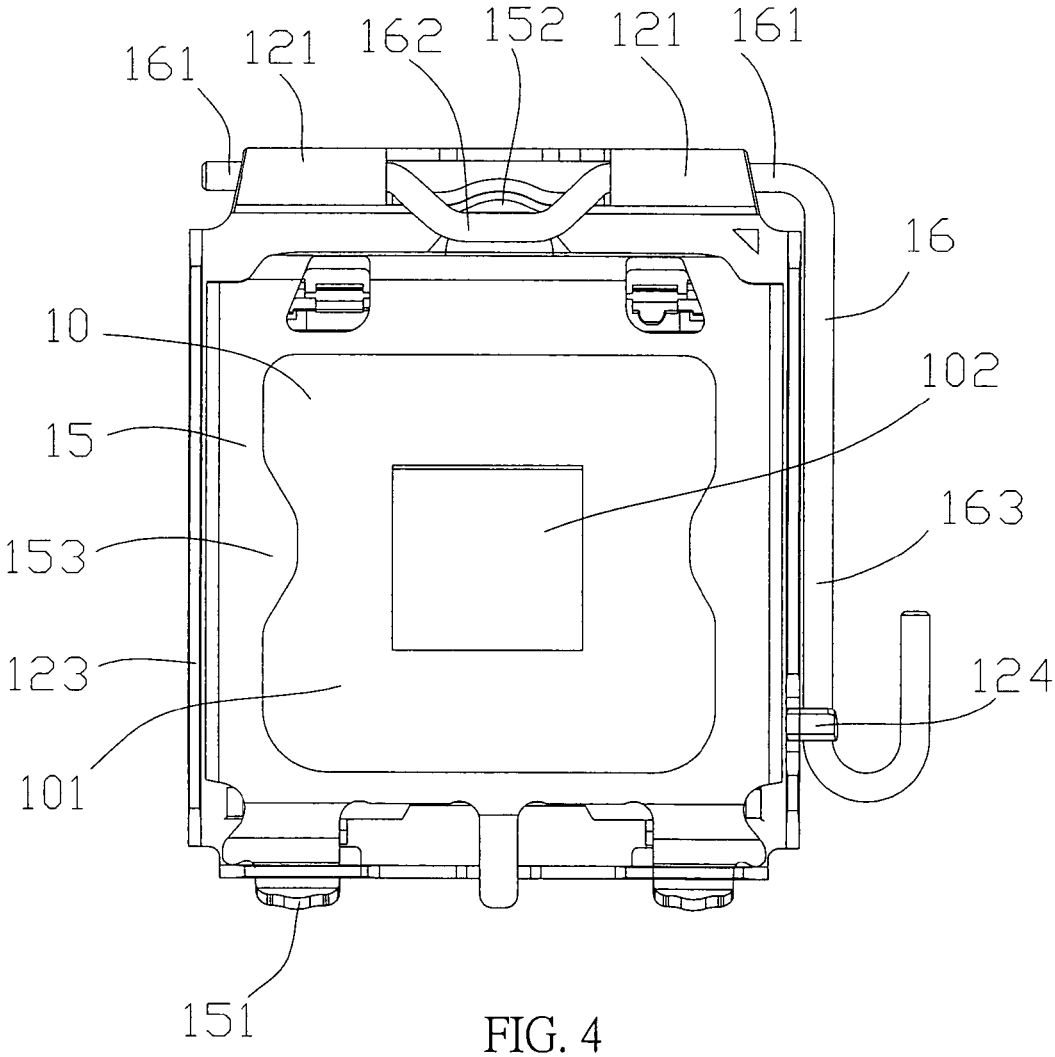
FIG. 4 is a top view of an electric connector of the present invention, when an attaching cover is not installed.
Figure 5:
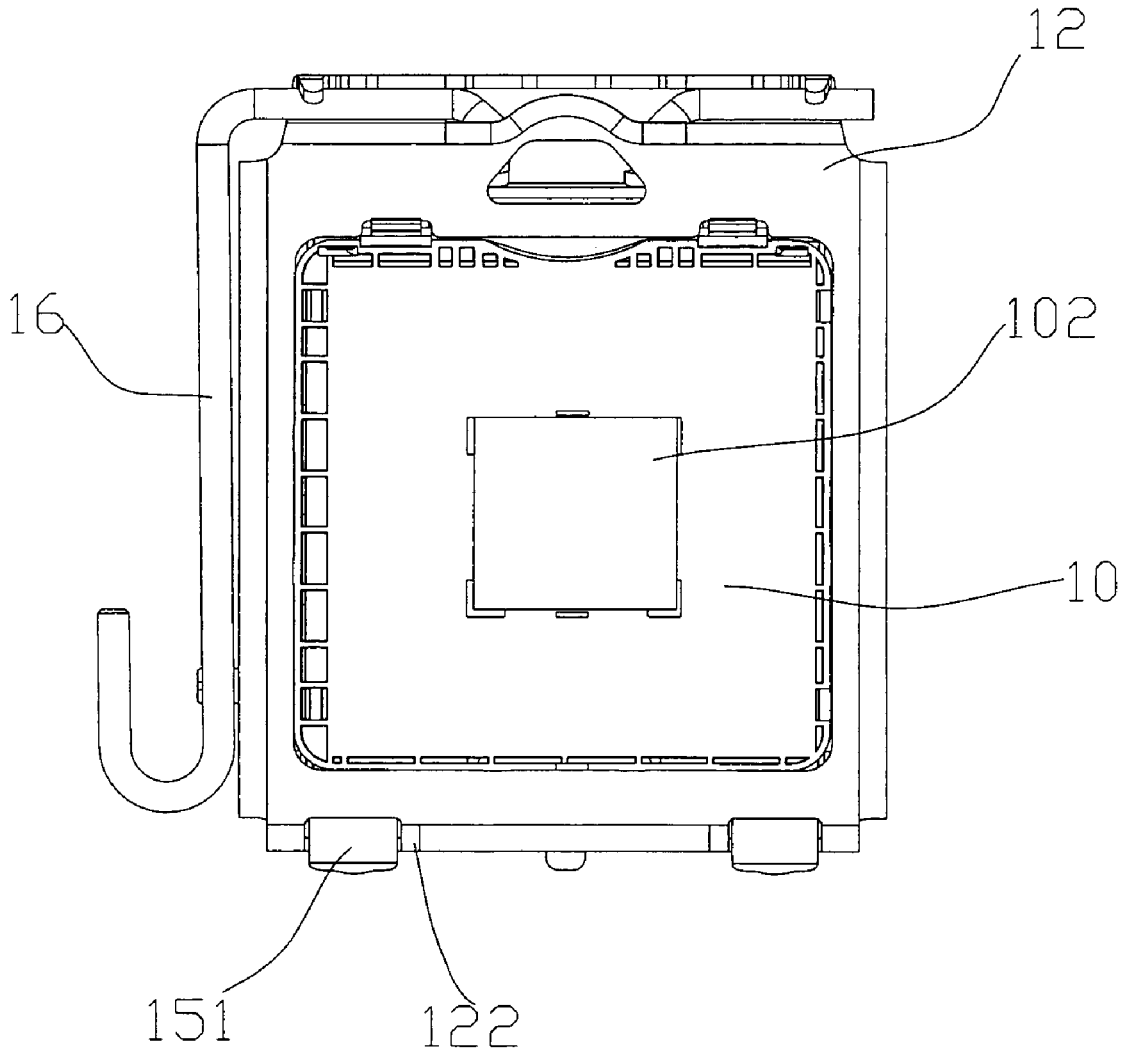
FIG. 5 is a bottom view of an electric connector of the present invention as depicted in FIG. 4, when an attaching cover is not installed.
Figure 6:
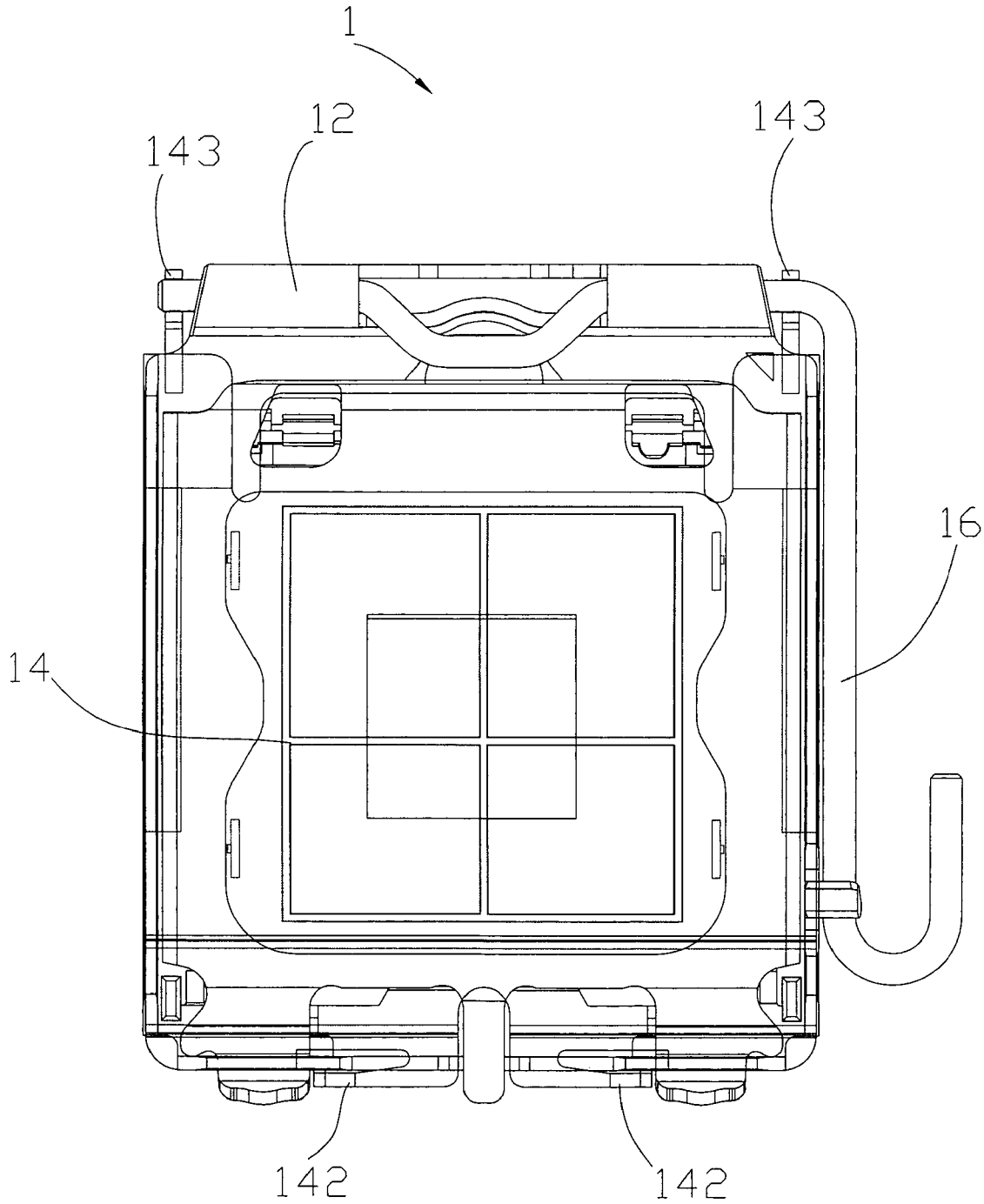
FIG. 6 is a schematic view of an attaching cover as depicted in FIG. 1 being attached to an electric connector as depicted in FIG. 4 according to the present invention.
Figure 7:
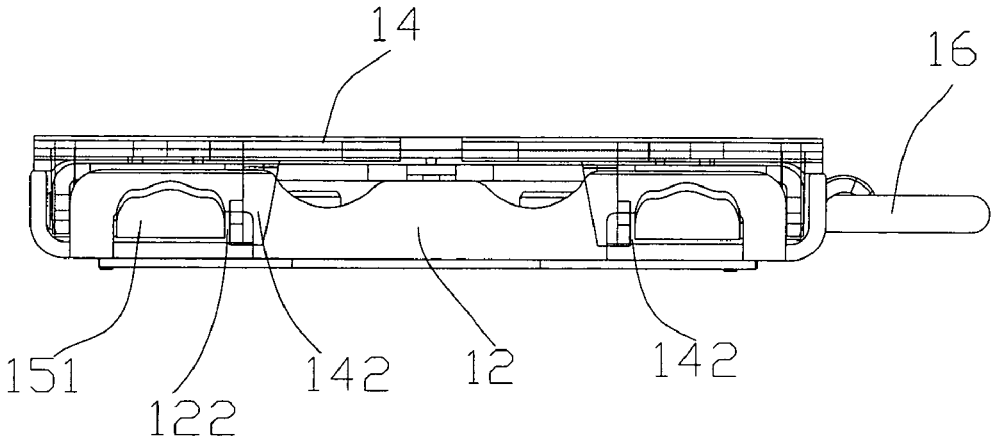
FIG. 7 is a left side view of the present invention as depicted in FIG. 6.
Figure 8:
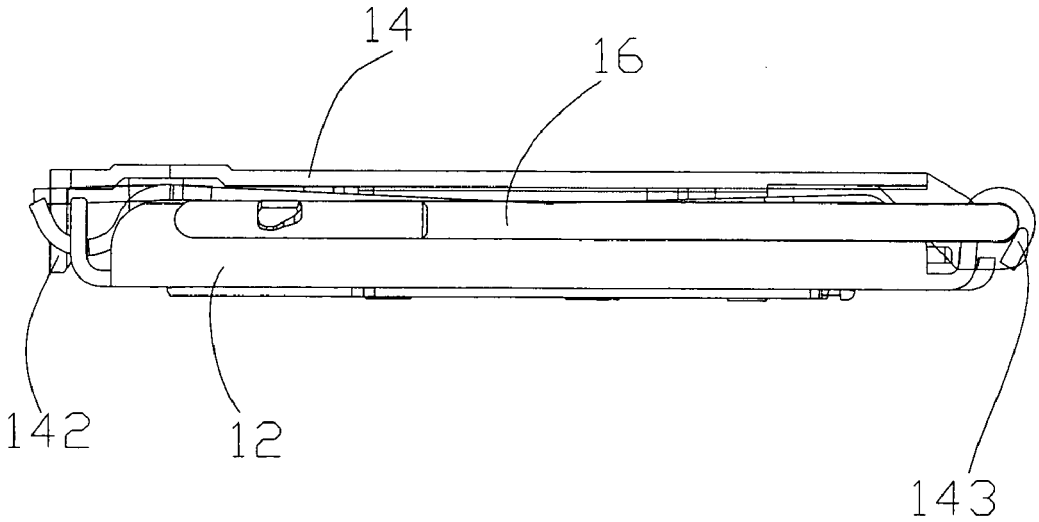
FIG. 8 is a right side view of the present invention as depicted in FIG. 6.

The present invention will now be described in more detail hereinafter with reference to the accompanying drawings that show various embodiments of the invention.

Referring to FIGS. 1 to 8 for the electric connector 1 of the invention used for connecting a chip module (not shown in the figure) comprises an insulating body 10, and electric conducting terminal (not shown in the figure), a latch base 12, an attaching cover 14, an upper casing 15 separately and pivotally coupled to both ends of the latch base 12 for pressing the chip module, and a lever 16 disposed on the latch base 12 for pressing the upper casing 15.

The insulating body 10 includes a retaining portion 101 disposed thereon for carrying the chip module (not shown in the figure), and the retaining portion 101 includes a plurality of terminal containing holes (not shown in the figure) disposed thereon for containing the electric conducting terminal (not shown in the figure), and the insulating body at its central position includes a square hole 102.

The latch base 12 is in the form of a square frame, and the insulating body 10 can be contained therein. The latch base 12 includes a holding portion 121 bent outwardly from an end of the latch base 12 for pivotally connecting the lever 16, and a rotary axle hole 122 is disposed on another end opposite to the holding portion 121 and movably connected to the upper casing 15. The rotary axle hole 122 is larger than an upper casing connecting end, and the latch base 12 includes a blocking wall 123 separately disposed on both sides other than that having a holding portion 121 and a rotary axle hole 122, and one of the blocking walls 123 includes an latching portion 124 bent outwardly and latched with the lever 16 when the lever is closed.

The upper casing 15 includes a frame structure having through holes at its middle, and the upper casing 15 includes a pivotal connecting end 151 corresponding to the rotary axle hole 122 and a latching end 152 extended outwardly from another end opposite to the pivotal connecting end 151. If the lever 16 is closed, the latching end 152 will press on the latch base 12. The upper casing 15 also includes a frame 153 disposed on the retaining portion 101 for pressing and fixing the chip module (not shown in the figure) onto the insulating body 10.

The lever 16 includes two pivotal connecting portions 161 pivotally coupled to the holding portion 121 on the latch base 12, a pressing portion 162 protruded inward from two pivotal connecting portions 161, and a pivotal connecting portion extended vertically from an external side to define an operating portion 163.

The attaching cover 14 is a transparent cover (which also could be a semi-translucent cover) made of a transparent material and comprises a body 140 having a flat upper surface and a reinforcing rib 141 extended downwardly from the lower surface of the body 140, and the reinforcing ribs 141 are crossed and connected with each other in the shape of a square symmetrically divided into four smaller squares The reinforcing rib 141 can improve the strength of the attaching cover 14 to prevent the attaching cover 14 from being deformed. Two first hooks 142 are extended from an end of the attaching cover body, and the two first hooks are formed by extending both sides of a same end in opposite directions, and the first hook 142 includes a first elastic arm 1421 extended from the body 140 and disposed at the same level of the body 140, a second elastic arm 1422 vertically coupled with the first elastic arm, and a first hook portion 1423 extended inwardly from a free end of the second elastic arm, and the first hook portion 1423 can be latched to the upper edge of a rotary axle hole 122 on the latch base 12. Two second hooks 143 are disposed at another end opposite to the first hooks 142, and the second hooks 143 are formed by being extended downward from the body and then extended outward, and its end includes a second hook portion 1433, and the second hook 143 can be fixed to the external ends of the two pivotal connecting portions 161 of the lever 16. A positioning member 144 is disposed separately on both sides of the lower surface of the attaching cover and opposite to the edge of the through hole of the upper casing, and the end of the positioning member 144 is substantially in a wedge-shape.

Since the first and second hooks 142, 143 are extended downward from both ends of the attaching cover 14 separately, the first hook 142 is latched to the rotary axle hole 122 of the latch base 12, and the second hook 143 is latched to the external end of the two pivotal connecting portions 161 of the lever 16. It is not necessary to latch the attaching cover 14 directly onto the upper casing 15 to avoid redesigning the attaching cover when there is a slight modification of the structure of the upper casing (or for the electric connector without an upper casing), and thus lowering the design and development cost of the attaching cover and improving the universal applicability of the attaching cover. Since the attaching cover 14 is transparent, therefore during the electric connector 1 is soldered onto the circuit board (not shown in the figure), the square hole 102 on the insulating body 10 can be aligned quickly with the corresponding position (not shown in the figure) on the circuit board, such that the soldered pins (not shown in the figure) of the terminal of the electric connector 1 can be inserted precisely into the soldering holes (not shown in the figure) of the circuit board to solder the electric connector 1 onto the circuit board quickly. Such arrangement can prevent the terminals from being broken, deformed, and failed due to the collisions of the unaligned terminal with the circuit board for many times.

Figure 9:
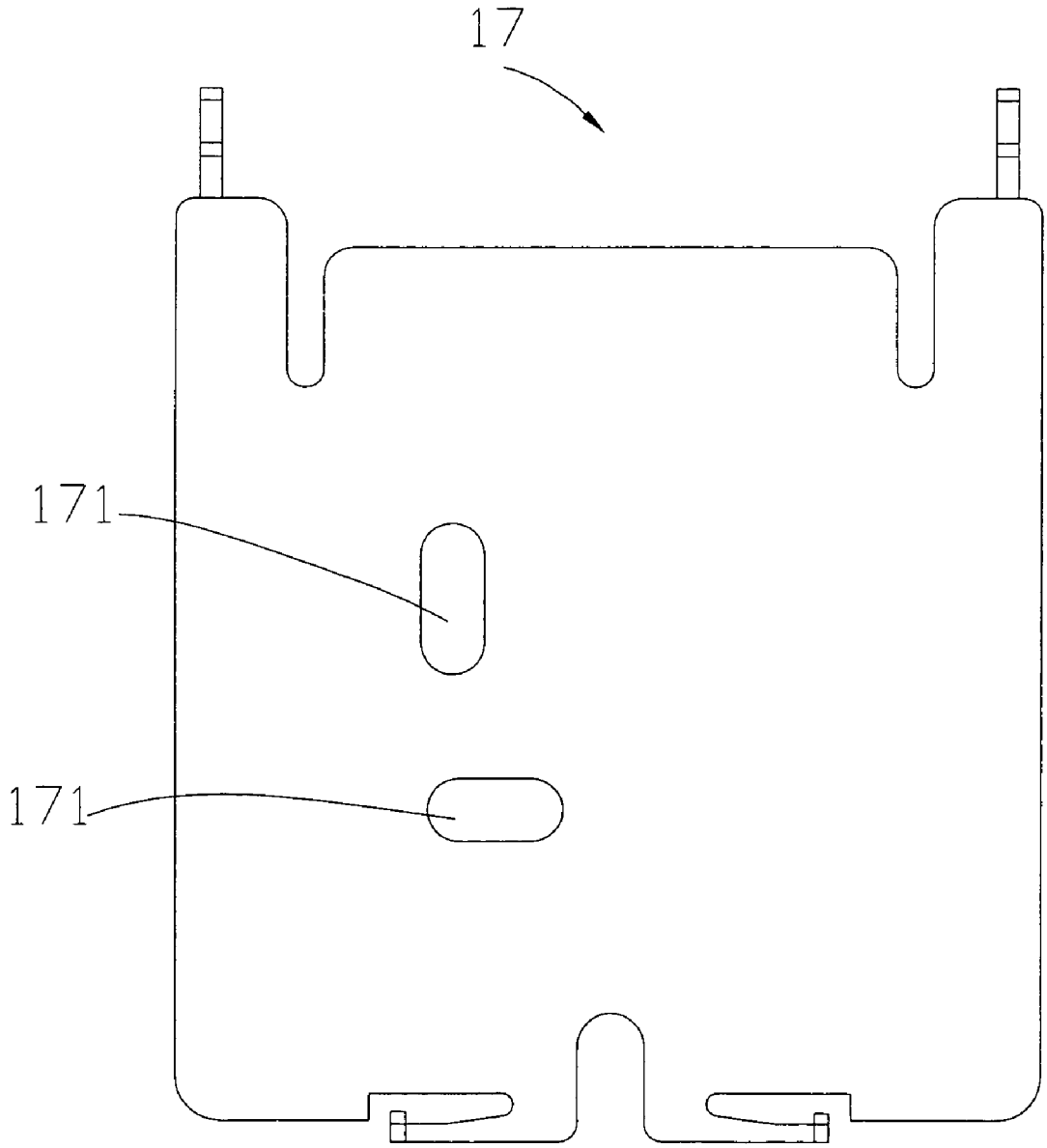
FIG. 9 is a top view of an attaching cover of an electric connector according to another preferred embodiment of the present invention.
Figure 10:
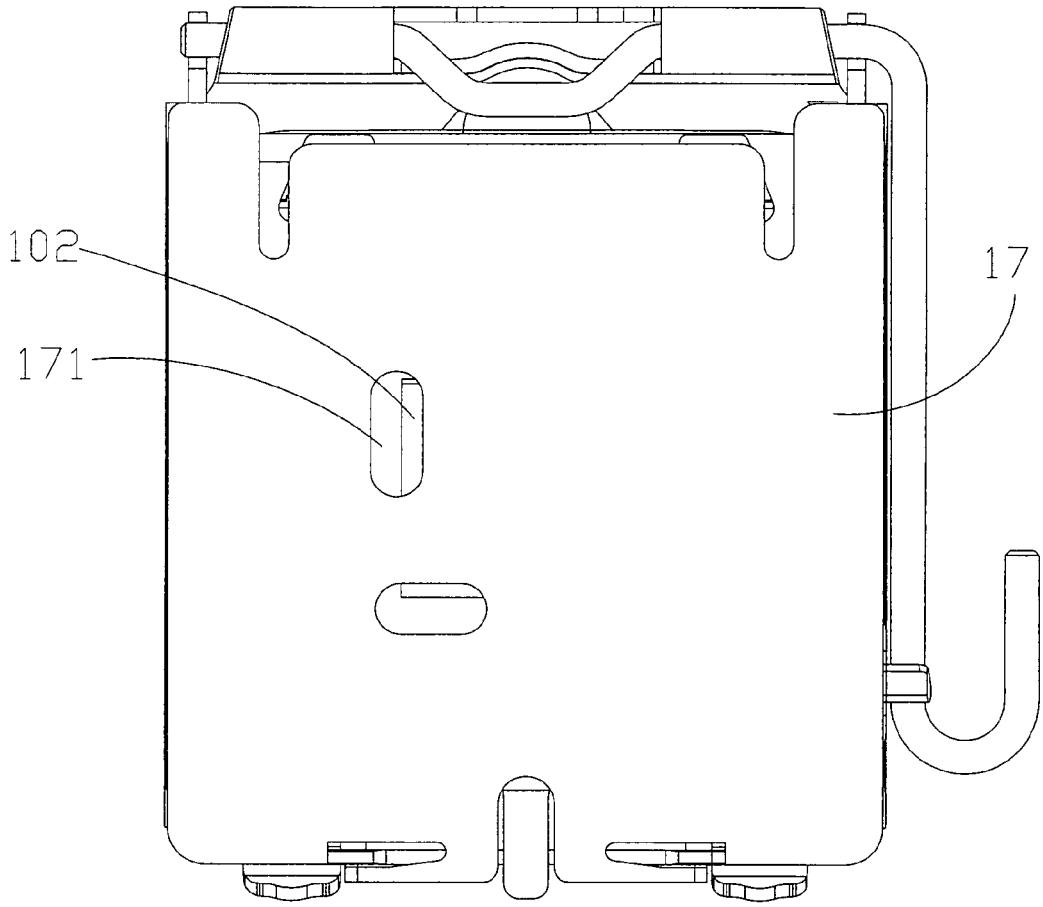
FIG. 10 is a schematic view of an attaching cover as depicted in FIG. 9 being attached to an electric connector as depicted in FIG. 4 according to the present invention.
Figure 11:
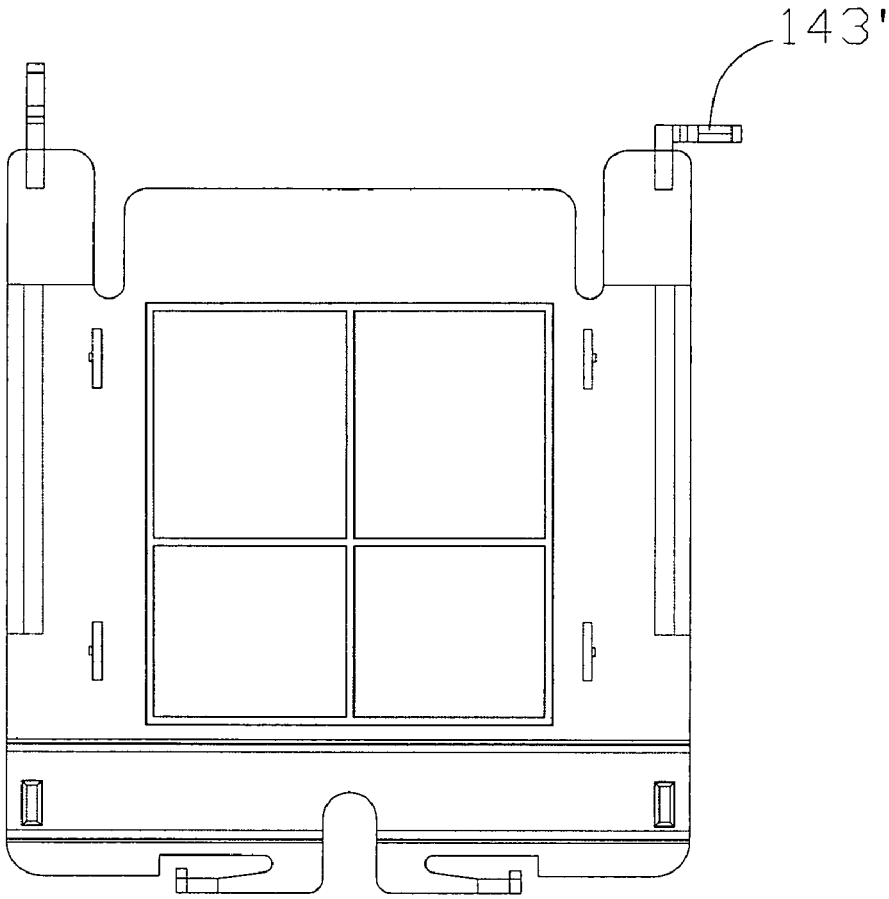
FIG. 11 is a top view of an attaching cover of an electric connector according to a further preferred embodiment of the present invention.
Figure 12:
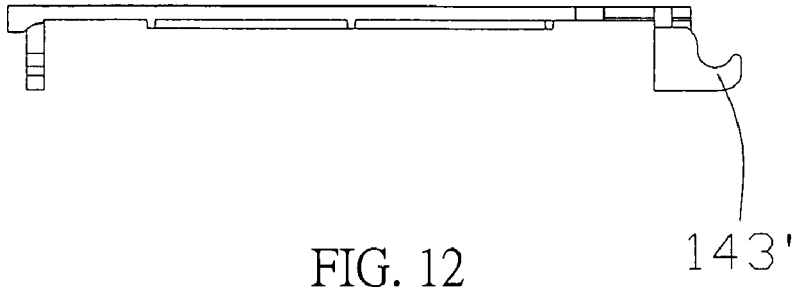
FIG. 12 is a main side view of an attaching cover as depicted in FIG. 11.
Figure 13:
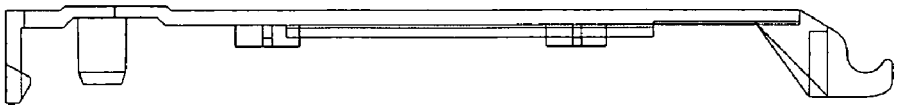
FIG. 13 is a left side view of an attaching cover as depicted in FIG. 11.
Figure 14:
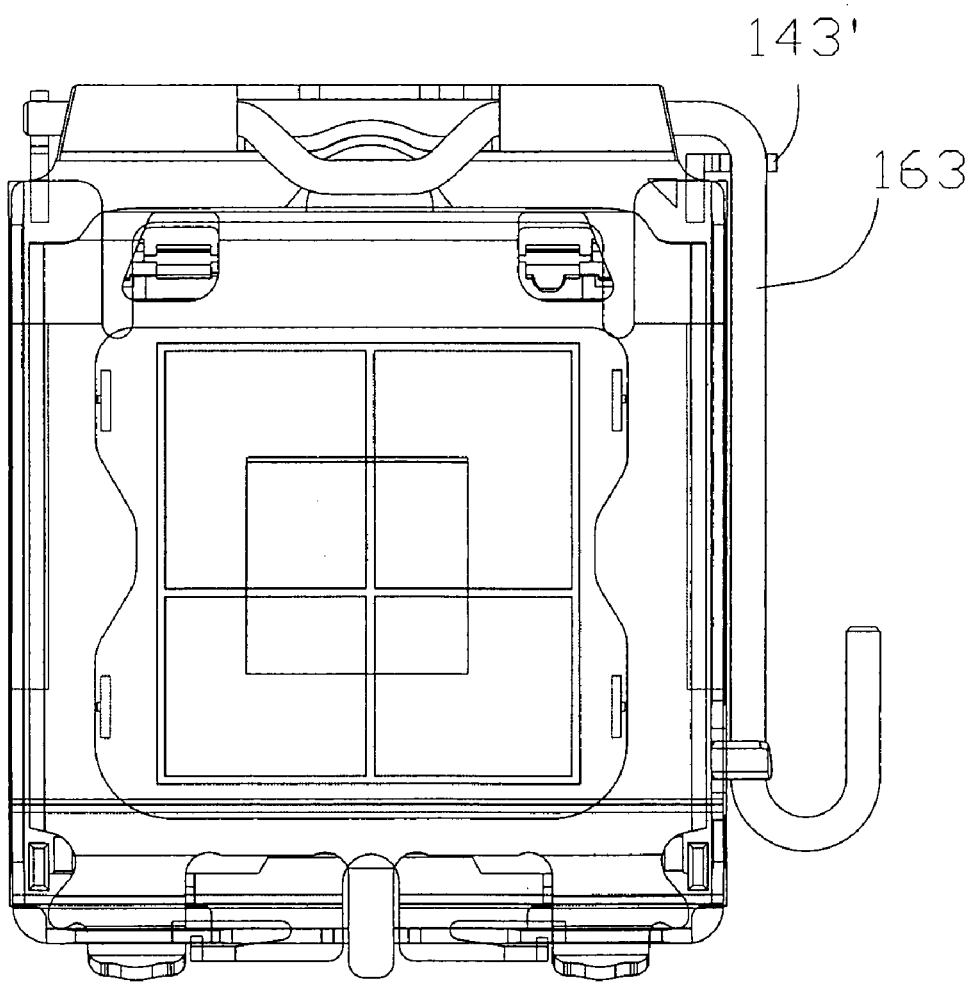
FIG. 14 is a schematic view of an attaching cover as depicted in FIG. 11 being attached to an electric connector as depicted in FIG. 4 according to the present invention.

Referring to FIGS. 9 and 10 for an electric connector according to a second preferred embodiment of the present invention, the difference with the first preferred embodiment resides on that the attaching cover 17 is opaque, and the attaching cover 17 includes a hole 171 thereon, such that the hole 171 allows us to see the intersected lines at the corners through a square hole 102 in the middle of the insulating body. In the practice of the second preferred embodiment of the invention, the same foregoing objectives can be achieved.

Referring to FIGS. 11 to 14 for the third preferred embodiment of the present invention, the difference with the first preferred embodiment resides on that a second hook 143' of the attaching cover is formed by being extended downward from the attaching cover body and then extended outward, and end of the second hook 143' is a second hook portion, and the second hook 143' is fixed to the operating portion 163 of the lever 16. Of course, the attaching cover 14 also can be designed as opaque. Like the second preferred embodiment, the attaching cover 14 includes a hole 171, such that the hole 171 allows us to see the intersected lines at the corners through the square hole 102 at the middle of the insulating body 10. In the practice of the third preferred embodiment of the invention, the same foregoing objectives can be achieved.

In the practice of the present invention, the containing hole is formed by enclosing a higher blocking wall and a lower blocking wall, so that the electric conducting terminal can be extended partially to the top of the lower blocking wall in favor of a dense layout and meets the requirements of the high-frequency circuits for providing a fast data transmission between an electronic component and the circuit board, and thus the present invention can definitely overcome the shortcomings of the prior art electric connector.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

In summation of the above description, the present invention herein enhances the performance than the conventional structure and further complies with the patent application requirements and is submitted to the Patent and Trademark Office for review and granting of the commensurate patent rights.

What is claimed is:

1. An electric connector, for connecting a chip module, comprising:

an insulating body having a retaining portion for carrying said chip module, and said retaining portion having a plurality of terminal containing holes disposed thereon;

at least one electric conducting terminal being contained into at least one of said terminal containing holes;

a latch base for accommodating said insulating body, and having a holding portion bent externally from a first end of said latch base;

an attaching cover having a body disposed on an upper flat surface, and at least one side of said attaching cover pressing on said latch base, said attaching cover having two first hooks located on a first end and two second hooks located on a second end; and an upper casing pivotally connected to a second end opposite to the first end of the latch base for pressing said chip module, the upper casing is positioned between the latch base and attaching cover, wherein the two first hooks of said attaching cover latching said attaching cover to said latch base at the second end.

2. The electric connector of claim 1, wherein each first hook of the two first hooks includes a first elastic arm extended from said body of said attaching cover and disposed at the same level with said attaching cover body, and a second elastic arm vertically coupled with said first elastic arm, and said second elastic arm includes a hook portion extended inwardly from a free end of said second elastic arm, and said hook portion is latched with said latch base.

3. The electric connector of claim 1, wherein said latch base further comprises a lever pivotally coupled to the first end of said latch base, and said lever further comprises a pressing portion, two pivotal connecting portions, and an operating portion, and said two second hooks are connected to said lever, and one of said two second hooks is latched to each of the two pivotal connecting portions.

4. The electric connector of claim 3, wherein each of said second hooks is formed by extending downwardly from said attaching cover body and then extending outwardly, and each of said second hooks further comprises a second hook portion disposed at an end of said second hook.

5. The electric connector of claim 1, wherein said attaching cover is a transparent cover or a semi-translucent cover.

6. The electric connector of claim 1, wherein said attaching cover body further comprises reinforcing ribs extended downward from said attaching cover body.

7. The electric connector of claim 1, further comprising a lever pivotally connected to the holding portion of said latch base and selectively pressing said upper casing onto said latch base, and the latch base having a rotary axle hole located in the second end opposite said holding portion, said upper casing is pivotally connected to the rotary axle hole of said latch base, said first hooks are latched to said rotary axle hole of said latch base, and said second hooks are latched onto said lever.

8. The electric connector of claim 7, wherein said latch base includes a blocking wall separately disposed on another two sides other than that having said holding portion and said rotary axle hole, and said blocking wall includes a latching portion bent outward from said blocking wall and latched with said lever when said lever is closed.

9. The electric connector of claim 7, wherein said upper casing comprises a pivotal connecting end corresponding to said rotary axle hole, a latching end extended outward from other end opposite to said pivotal connecting end, such that if said lever is closed, said latching end is pressed onto said latch base, and said upper casing further comprises a frame disposed on said retaining portion for pressing said chip module onto said insulating body.

10. The electric connector of claim 1, wherein said attaching cover having two sides pressing on two sides of said latch base respectively.

11. An electric connector, for connecting a chip module, comprising:

an insulating body having a retaining portion for carrying said chip module, and said retaining portion having a plurality of terminal containing holes disposed thereon;

at least one electric conducting terminal being contained into at least one of said terminal containing holes;

a latch base for accommodating said insulating body, and having a holding portion bent externally from a first end of said latch base;

an attaching cover having a body disposed on an upper flat surface, and at least one side of said attaching cover pressing on said latch base, wherein said attaching cover having at least one end includes a hook for latching said latch base, wherein said hook further comprises a first elastic arm extended from said body of said attaching cover and disposed at the same level with said attaching cover body, and a second elastic arm vertically coupled with said first elastic arm, and said second elastic arm includes a hook portion extended inwardly from a free end of said second elastic arm, and said hook portion is latched with said latch base at a second end opposite to the first end; and an upper casing pivotally connected to the second end of the latch base for pressing said chip module, the upper casing is positioned between the latch base and attaching cover.

* * * * *